US007242273B2

(12) United States Patent
Isobe et al.

(10) Patent No.: US 7,242,273 B2
(45) Date of Patent: Jul. 10, 2007

(54) RF-MEMS SWITCH AND ITS FABRICATION METHOD

(75) Inventors: Atsushi Isobe, Kodaira (JP); Akihisa Terano, Hachioji (JP); Kengo Asai, Hachioji (JP); Hiroyuki Uchiyama, Musashimurayama (JP); Hisanori Matsumoto, Kokubunji (JP)

(73) Assignee: Hitachi Media Electronics Co., Ltd., Mizusawa-shi, Iwate-ken (JP)

( * ) Notice: Subject to any disclaimer, the term of this patent is extended or adjusted under 35 U.S.C. 154(b) by 0 days.

(21) Appl. No.: 10/902,573

(22) Filed: Jul. 30, 2004

(65) Prior Publication Data

US 2005/0099252 A1 May 12, 2005

(30) Foreign Application Priority Data

Nov. 10, 2003 (JP) ..... 2003-379390

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 5,578,976 A 11/1996 Yao ..... 333/262
6,115,231 A * 9/2000 Shirakawa ..... 361/233
6,646,215 B1 * 11/2003 Nelson ..... 200/181
6,714,105 B2 * 3/2004 Eliacin et al. ..... 333/262
6,876,283 B1 * 4/2005 Weber et al. ..... 335/78
7,053,736 B2 * 5/2006 Nelson ..... 335/70
2002/0055260 A1 5/2002 Chow et al. ..... 438/689
2002/0149071 A1 10/2002 Shim ..... 257/415

FOREIGN PATENT DOCUMENTS

JP 09-017300 1/1997
JP 10-068896 3/1998
JP 2002-326197 11/2002

* cited by examiner

*Primary Examiner*—K. Lee
*Assistant Examiner*—Bernard Rojas
(74) *Attorney, Agent, or Firm*—Miles & Stockbridge PC

(57) ABSTRACT

The MEMS switch comprises a first anchor formed over a substrate, a first spring connected to the first anchor, an upper electrode which is connected to the first spring and makes a motion above the substrate, elastically deforming the first spring, a lower electrode formed over the substrate, positioned under the upper electrode, a second spring connected to the upper electrode, and a second anchor connected to the second spring. When voltage is applied between the upper and lower electrodes and the upper electrode makes a downward motion, the second anchor is brought into contact with the substrate. As a result, the second spring is elastically deformed. When the upper electrode is subsequently brought into contact with the lower electrode, thereby the upper and lower electrodes are electrically connected. The first and second anchors, first and second springs, and upper electrode are formed of identical metal in integral structure.

8 Claims, 13 Drawing Sheets

RF-MEMS SWITCH AND ITS FABRICATION METHOD

CLAIM OF PRIORITY

The present application claims priority from Japanese application JP 2003-379390 filed on Nov. 10, 2003, the content of which is hereby incorporated by reference in this application.

FIELD OF THE INVENTION

The present invention relates to a MEMS (Micro-Electro-Mechanical Systems) switch and its fabrication method. More particularly, it relates to a MEMS switch which turns on and off electrical signals of a wide range of frequency ranging from several hundreds of megahertz to several gigahertz or more and its fabrication method.

BACKGROUND OF THE INVENTION

Conventionally, MEMS switch has been known as a microscopic electromechanical component for turning on and off electrical signals. For example, the MEMS switch disclosed in Japanese Patent Laid-Open No. H9-17300 is fabricated over a substrate by a fine structure fabrication technique for use in the fabrication of semiconductor devices. A projection, which functions as an anchor (support), of an insulator is formed over a substrate, and a beam of an insulating film is fixed on the anchor. An upper electrode is formed at the upper part of the beam, and a contact portion facing downward is formed at the tip of the beam. A lower electrode is formed over the substrate opposite to the upper electrode, and a signal line is formed over the substrate under the contact portion.

When voltage is not applied to the upper or lower electrode, the contact portion and the signal line are away from each other, and the switch is off. When voltage is applied, the beam is elastically deformed by Coulomb force exerted between the upper electrode and the lower electrode, and is warped toward the substrate. As a result, the contact portion is brought into contact with the signal line, and the switch is thereby turned on.

In mobile telephones and the like, a battery is used as power supply, and thus switch operation must be performed on 3V or so. To lower the operating voltage, the restoring force of springs must be reduced. However, when the restoring force is weakened as mentioned above, the upper electrode and the lower electrode or the contact portion and the signal line do not separate from each other due to sticking phenomenon. As a result, the operating voltage becomes difficult to lower.

An example of methods for solving this problem is disclosed in Japanese Patent Laid-Open No. 2002-326197. This method is such that a projection is formed at some point on a spring and thereby the restoring force is increased when a sticking phenomenon takes place.

SUMMARY OF THE INVENTION

The conventional MEMS switch mentioned above has the following problems.

If a projection is provided at some point on a spring, the film structure (hereafter, referred to as "membrane") partially constituting the spring becomes multilayer structure. The multilayer structure of a membrane produces residual inside stress and increases the elastic factor of the spring.

This brings a limitation to lowering voltage. Further, the membrane is warped by the difference in inside stress or in coefficient of thermal expansion between layers.

For example, when a warp, 600 μm in radius of curvature, occurs in a membrane, 100 μm in length, the deformation in the center of the membrane is 2 μm. When the membrane is warped downward convexly, the upper and lower electrodes are brought into contact with each other before voltage is applied. When the membrane is warped upward convexly, the gap becomes 4 μm, and the operating voltage is increased by a factor of 4.

For this reason, a warp must be suppressed with very high accuracy. When a multilayer film is used, a warp may not be produced at room temperature. Even in this case, however, a warp is produced due to a difference in coefficient of thermal expansion: a warp occurs when the temperature exceeds or falls below room temperature. For this reason, in a MEMS switch using a multilayer film, a warp is very difficult to suppress, and the temperature range within which low-voltage operation is feasible is inevitably and significantly narrowed.

A major object of the present invention is to solve these problems and provide a MEMS switch which operates at low voltage with stability and its fabrication method.

Further, an additional object of the present invention is to provide an inexpensive MEMS switch provided with a membrane which is of simple structure and attains high processing accuracy, and its fabrication method.

The MEMS switch according to the present invention for attaining the above major object comprises: a first anchor formed over a substrate; a first spring connected to the first anchor; an upper electrode which is connected to the first spring and makes a motion above the substrate, elastically deforming the first spring; a lower electrode formed over the substrate and positioned under the upper electrode; a second spring connected to the upper electrode; and a second anchor connected to the second spring. When voltage is applied to between the upper electrode and the lower electrode and the upper electrode makes a downward motion, the second anchor is brought into contact with the substrate. As a result, the second spring is elastically deformed and subsequently the upper electrode is brought into contact with the lower electrode. Thereby, the upper electrode and the lower electrode are electrically connected with each other.

With the above structure, when voltage is applied to between the upper electrode and the lower electrode and the upper electrode gets close to the substrate, the Coulomb force is increased. In this stage, the second spring works and subsequently the upper electrode is brought into contact with the lower electrode. As the result, the switch is turned on. When voltage application is stopped and the switch is turned off, strong restoring force obtained by adding the restoring force of the first spring and that of the second spring is obtained. Thus, the upper electrode is separated from the lower electrode without fail. According to this, the restoring force of the first spring can be weakened, and the applied voltage can be lowered.

Further, to attain the above additional object, the following constitution is preferable: the first spring, first anchor, second spring, second anchor, and upper electrode are formed in integral structure to obtain a membrane. Further, these elements are preferably formed of a continuous identical metallic body. Thus, the membrane of integral structure is obtained by forming a metallic film once and patterning it.

As a result, an inexpensive MEMS switch provided with a membrane which is of simple structure and attains high processing accuracy and its fabrication method are obtained.

These and other objects and many of the attendant advantages of the invention will be readily appreciated, as the same becomes better understood by reference to the following detailed description when considered in connection with the accompanying drawings.

BRIEF DESCRIPTION OF THE PREFERRED EMBODIMENTS

DETAILED DESCRIPTION OF THE PREFERRED EMBODIMENTS

Figure 1:
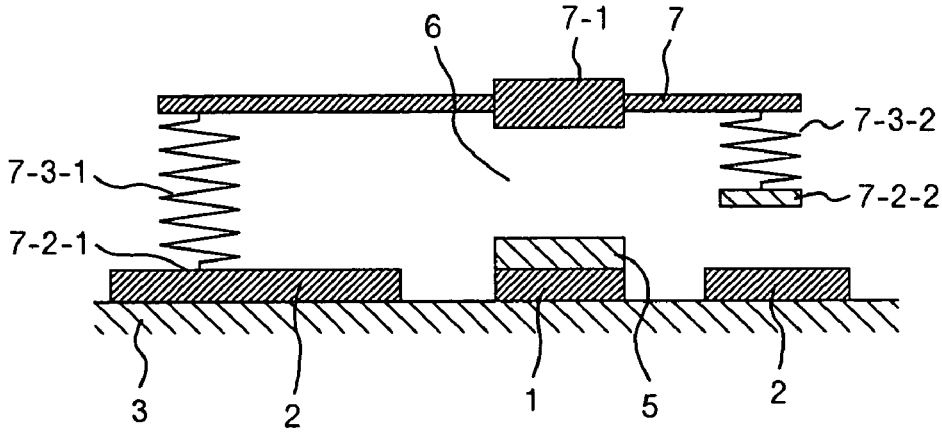
FIG. 1 is a schematic diagram explaining a first embodiment of the MEMS switch according to the present invention.

Referring to some preferred embodiments illustrated in the drawings, the MEMS switch according to the present invention will be described in further detail below.

FIG. 1 illustrates the first embodiment of the present invention in the form of schematic diagram. A signal line 1 and a ground 2 are formed over an insulating substrate 3. The insulating substrate 3 is formed of, for example, an insulating material, such as glass substrate, compound semiconductor substrate, high-resistance silicon substrate, and piezoelectric substrate. The insulating substrate 3 may be a semiinsulating substrate or a conductor substrate, whose surface is covered with an insulating film typified by silicon dioxide.

The signal line 1, together with the ground 2 provided at a predetermined distance, functions as a coplanar type RF (Radio Frequency) wave guide line which extends frontward and rearward in the figure. The surface of the signal line 1 is covered with a dielectric film 5. A membrane 7 is provided over the dielectric film 5 with a gap 6 in-between. The membrane 7 comprises an upper electrode 7-1, a plurality of anchors 7-2, and a plurality of springs 7-3. The upper electrode 7-1, the plural anchors 7-2, and the plural springs 7-3 are all formed of continuous low-resistance metallic material in integral structure. The first spring 7-3-1 and the second spring 7-3-2 are connected to the upper electrode 7-1. The first spring 7-3-1 is connected to the first anchor 7-2-1, and the second spring 7-3-2 is connected to the second anchor 7-2-2. The first anchor 7-2-1 is mechanically connected with the insulating substrate 3. Both the springs 7-3 are linear springs whose displacement and restoring force are linear.

The ground 2 is connected to the ground not only in high frequency but also in DC (Direct Current) (DC potential: 0V) Therefore, the upper electrode 7-1 is connected to the ground through the first spring 7-3-1 and the first anchor 7-2-1.

Figure 2:
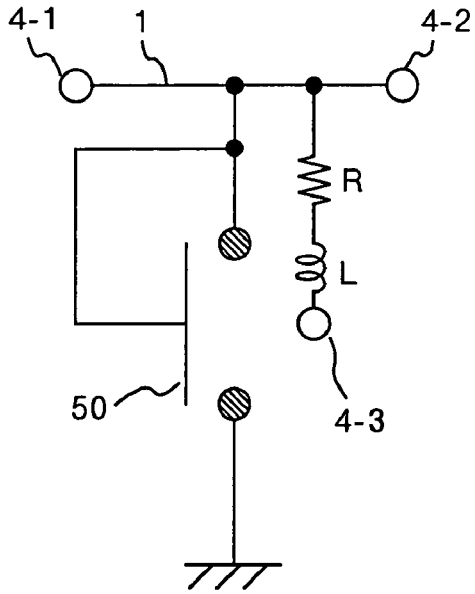
FIG. 2 is an equivalent circuit diagram explaining the first embodiment of the present invention and its control circuit.

FIG. 2 is an equivalent circuit diagram of the MEMS switch and its control circuit. The upper electrode 7-1 functions as a capacitive switch 50 connected in parallel with the signal line 1. The signal line 1 is not connected in DC, and a control terminal 4-3 is connected with the signal line 1 through an inductance L which gives high impedance at high frequency and a resistor R. Thus, the signal line 1 also has a function of the lower electrode of the switch. More specific description will be given. When DC voltage for control is applied to the control terminal 4-3, the same DC voltage is applied to the signal line 1, that is, the lower electrode through the inductance L and the resistor R.

When DC voltage is not applied to the signal line 1 (DC potential: 0V), the upper electrode 7-1 is mechanically supported by the first spring 7-3-1 and the second spring 7-3-2, as illustrated in FIG. 1. The upper electrode 7-1 is sufficiently away from the signal line 1, and thus the capacitance between the upper electrode 7-1 and the signal line 1 is very small (switch off state). At this time, an RF signal passed through the signal line 1 is transmitted from its input terminal 4-1 to output terminal 4-2 with low loss.

When DC voltage is applied to the signal line 1, Coulomb force is produced between the upper electrode 7-1 and the signal line 1, that is, the lower electrode. When the Coulomb force is stronger than the restoring force of the springs, the upper electrode 7-1 is brought into contact with the insulating film 5 as when it is stuck to the insulating film 5 (switch on state).

In this switch on state, the upper electrode 7-1 approaches the signal line 1 with the dielectric film 5 in-between. Therefore, the capacitance between the upper electrode 7-1 and the signal line 1 becomes very large, this is equivalent at high frequency to that the signal line 1 is connected to the ground. At this time, the majority of the RF signal flowing from the input terminal 4-1 to the signal line 1 is reflected at the portion of the upper electrode 7-1 in contact with the dielectric film 5. Therefore, the RF signal hardly reaches the output terminal 4-2.

Since the second anchor 7-2-2 is floating in midair immediately after DC voltage is applied, the second spring 7-3-2 does not work. When the first spring 7-3-1 is deformed by a predetermined amount and the second anchor 7-2-2 is brought into contact with the substrate, the second spring 7-3-2 functions as a spring having restoring force.

Figure 3:
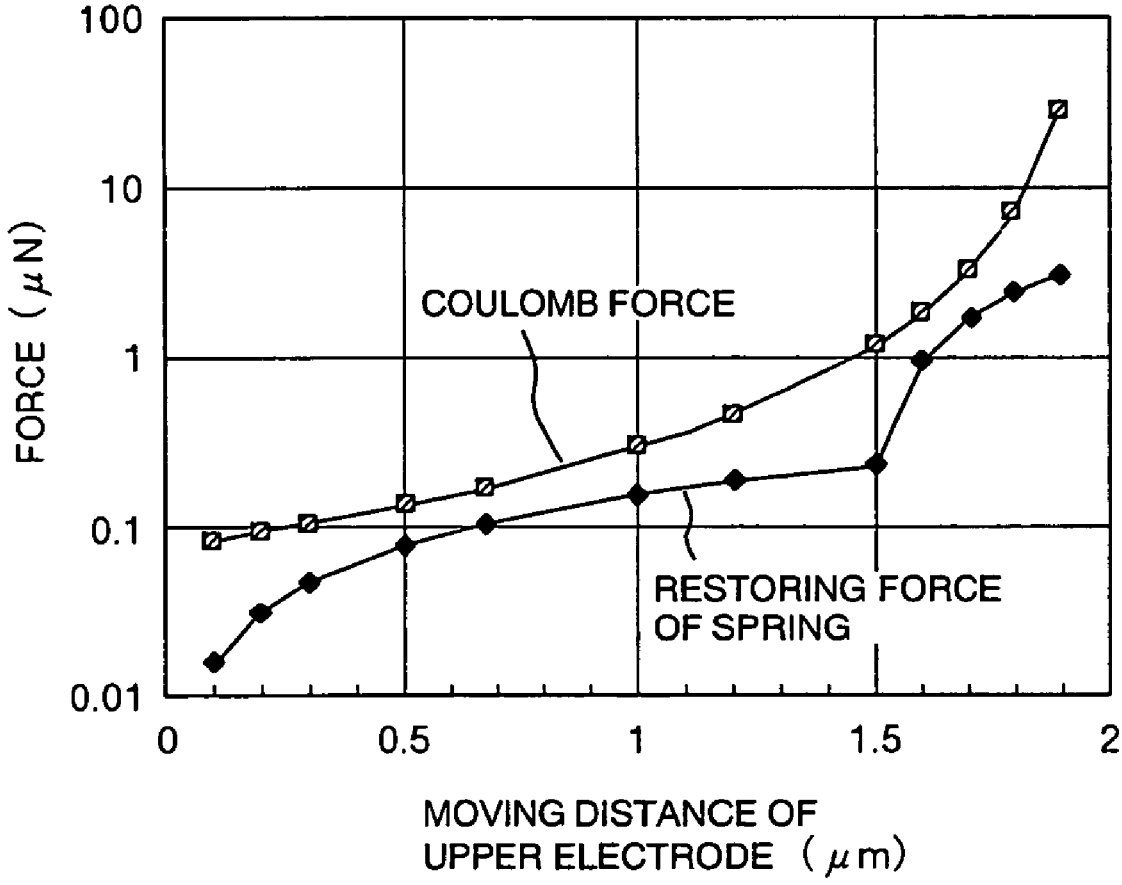
FIG. 3 is a curve chart illustrating the moving distance dependence of force exerted on the upper electrode in the first embodiment of the present invention.

FIG. 3 illustrates the relation between the moving distance of the upper electrode 7-1 directly above the center of the signal line 1 and the restoring force of the springs exerted on the upper electrode 7-1 at that time. Here, the assumption that the upper electrode 7-1 and the signal line 1 are parallel with each other is made. The distance between the anchor 7-2-2 and the ground 2 directly underneath is set to ¾ of the distance between the upper electrode 7-1 and the dielectric film 5 directly underneath. For this reason, when the anchor 7-2-2 is in contact with the ground 2 directly underneath, the displacement of the upper electrode is ¾ of the distance between the off position and the on position.

In the electrostatic MEMS switch which operates as mentioned above, the critical displacement is ⅓ of the gap, and the restoring force of the springs and Coulomb force is most compete with each other between 0 and ⅓. For this reason, the restoring force of the springs at ⅓ determines the applied voltage for turning on the switch, that is, pull-in voltage. In this embodiment, as illustrated in FIG. 3, the anchor 7-2-2 is floating in midair within the range from 0 to ¾. Therefore, the restoring force of the springs within the range from 0 to ⅓ is set to a low value. By setting the spring constant of the first spring 7-3-1 to 0.156 N/m, the pull-in voltage can be set to a value less than 3V.

In the electrostatic MEMS switch, the sticking phenomenon between the upper electrode 7-1 and the dielectric film 5 in contact with each other in on state poses a critical problem. When the sticking phenomenon is stronger than the restoring force of the springs, a problem arises. Even when the voltage is returned to 0V, the upper electrode 7-1 is kept in contact with the dielectric film 5, and off state is not established. In on state in this embodiment, the upper electrode 7-1 gets close to the dielectric film 5 and Coulomb force is enhanced, and thereafter the anchor 7-2-2 is brought into contact with the ground 2. Therefore, the restoring force of the second spring 7-3-2 can be set to a high value. Thus, the spring constant of the second spring 7-3-2 can be set so that the switch is stably returned to off state even when the contact tension is as relatively high as 20 μN. In this embodiment, specifically, the spring constant of the second spring 7-3-2 is set to 7.31 N/m, which is significantly stronger than that of the first spring 7-3-1.

According to the foregoing, this embodiment is constituted as follows: a first spring and a second spring are provided; the spring constant of the first spring is set to 0.156 N/m, and that of the second spring is set to 7.31 N/m; and the movement range of the second spring is set to the range between ¾ and 1. Thus, an RF-MEMS switch which stably operates at low voltage can be provided.

Figure 4:
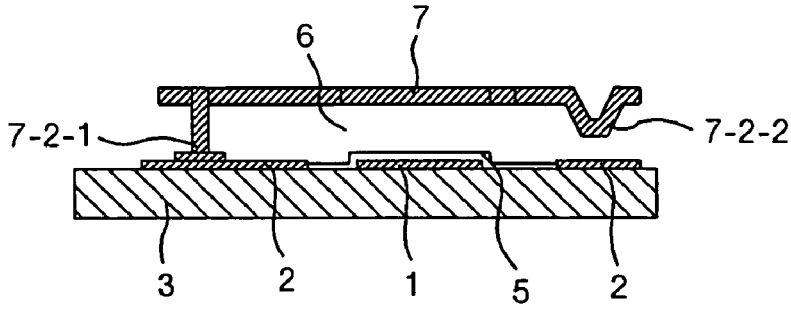
FIG. 4 is a cross-sectional view explaining a second embodiment of the present invention.
Figure 5:
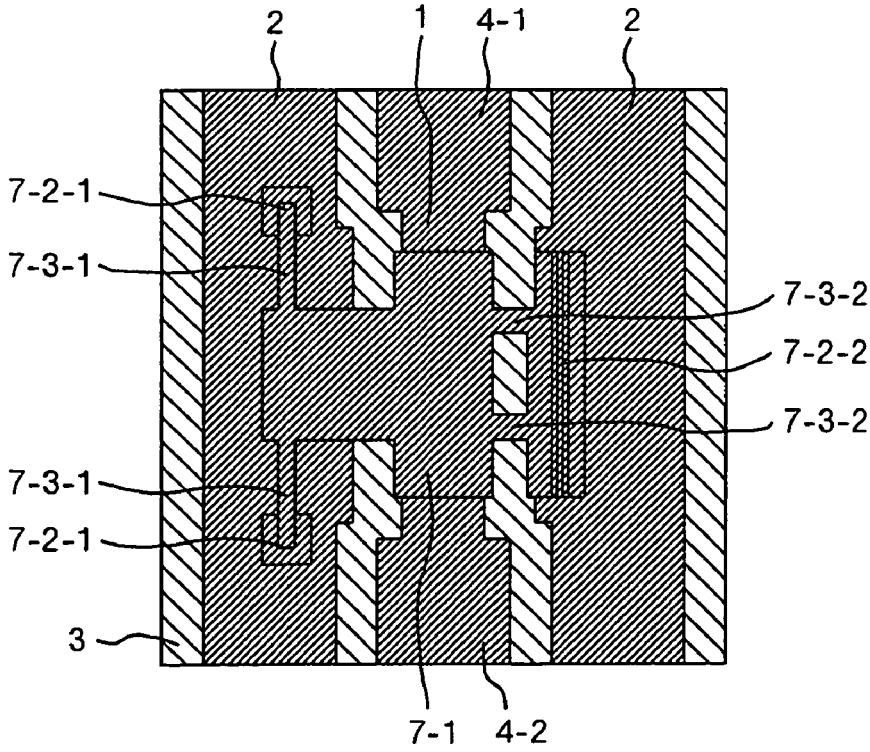
FIG. 5 is a top view explaining the second embodiment of the present invention.
Figure 6:
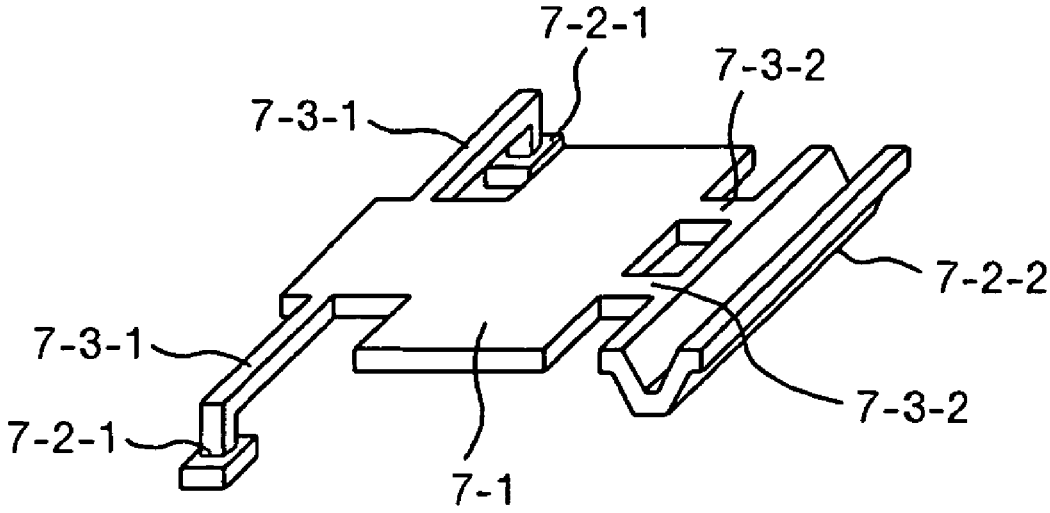
FIG. 6 is a perspective view explaining the structure of the membrane in the second embodiment of the present invention.

FIG. 4, FIG. 5, and FIG. 6 illustrate the second embodiment of the present invention. A signal line 1 and a ground 2 are formed of an Al film over an insulating substrate 3. The insulating substrate 3 is formed of a high-resistance silicon substrate covered with a thermal oxidation film. The signal line 1, together with the ground 2 provided at a predetermined distance, functions as a coplanar type RF wave guide line which extends upward and downward in FIG. 5. Parts of the surfaces of the signal line 1 and the ground 2 are covered with a silicon oxide film 5.

A membrane 7 is provided over the dielectric film 5 with a gap 6 in-between. The membrane 7 comprises an upper electrode 7-1, a plurality of anchors 7-2, and a plurality of springs 7-3. The upper electrode 7-1, the plural anchors 7-2, and the plural springs 7-3 are all formed of an aluminum film.

The first spring 7-3-1 and the second spring 7-3-2 are connected to the upper electrode 7-1. The first spring 7-3-1 is connected to the first anchor 7-2-1, and the second spring 7-3-2 is connected to the second anchor 7-2-2. The first anchor 7-2-1 is mechanically connected with the insulating substrate 3. The ground 2 is connected to the ground not only in high frequency but also in DC (DC potential: 0V). The upper electrode 7-1 is connected to the ground through the first spring 7-3-1 and the first anchor 7-2-1.

The electrical circuit of the switch in this embodiment is the same as illustrated in FIG. 2. The upper electrode 7-1 functions as a capacitive switch connected in parallel with the signal line 1. Here, the signal line 1 also has a function of the lower electrode of the switch.

The first spring 7-3-1 functions as a torsional spring, and is 50 μm in length, 2 μm in width, and 2 μm in thickness. Thereby, the torsional spring constant is set to 0.16 N/m. The second spring 7-3-2 functions as a flexible spring, and is 40 μm in length, 0.5 μm in width, and 2 μm in thickness. Thereby, the flexible spring constant is set to 1.7 N/m. Thus, the major restoring force of the first spring 7-3-1 is elastic force of a solid against torsion, and the major restoring force of the second spring 7-3-2 is elastic force of a solid against flexure.

The upper electrode 7-1 is set to 50 μm in length and 200 μm in width. The distance between the first spring 7-3-1 and the upper electrode 7-1 is set to 125 μm. The gap between the upper electrode 7-1 and the dielectric film 5 is set to 2 μm, and the gap between the second anchor 7-2-2 and the ground 2 is set to 1.5 μm. For this reason, when the second anchor 7-2-2 is in contact with the ground, the gap between the center of the upper electrode 7-1 and the dielectric film 5 is 1.1 μm.

If the upper electrode 7-1 and the signal line 1 is not parallel with each other, the capacitance C between them is expressed by Expression (1).

$$C = \frac{\varepsilon S}{g-h}\log\frac{g}{h} \tag{1}$$

where ∈ is dielectric constant; S is the area of the upper electrode 7-1; g is the largest gap distance; and h is the smallest gap distance. When rotational motion is disregarded, the Coulomb force Fq exerted on the upper electrode 7-1 can be approximately expressed by Expression (2).

$$F_q = -\frac{1}{2}\frac{\varepsilon S}{gh}V^2 \quad (2)$$

Thus, the critical point is less than ⅓. For this reason, the position of the upper electrode 7-1 when the anchor 7-2-2 is brought into contact with the ground 2 must be made greater than ⅓. The position of the upper electrode 7-1 at this time depends on the distances from both the anchors. When the upper electrode is provided immediately beside the second anchor 7-2-2, the position of the second anchor 7-2-2 is set to a value not more than ⅔ of the gap. When the upper electrode is provided at a midpoint between both the anchors, the position of the second anchor 7-2-2 is set to a value not more than ⅓. Thus, the effect is produced.

This embodiment is constituted as follows: a first spring and a second spring are provided; the spring constant of the first spring is set to 0.16 N/m and that of the second spring is set to 1.6 N/m; and the movement range of the second spring is made equal to the ratio of the displacement of the upper electrode to the gap, 0.55 to 1. Thus, an RF-MEMS switch which stably operates at low voltage can be provided. Further, the membrane is not of complicated multilayer structure, and thus the MEMS switch can be inexpensively implemented.

Figure 7:
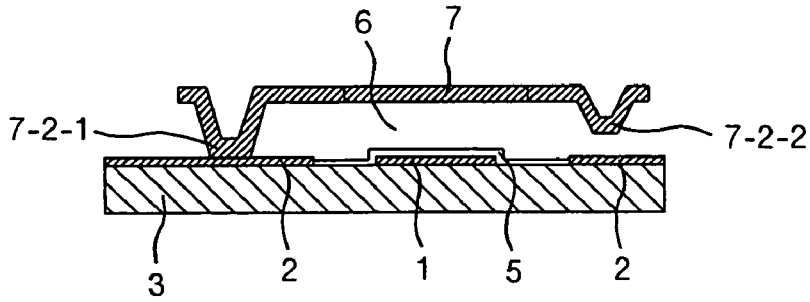
FIG. 7 is a cross-sectional view explaining a third embodiment of the present invention.
Figure 8:
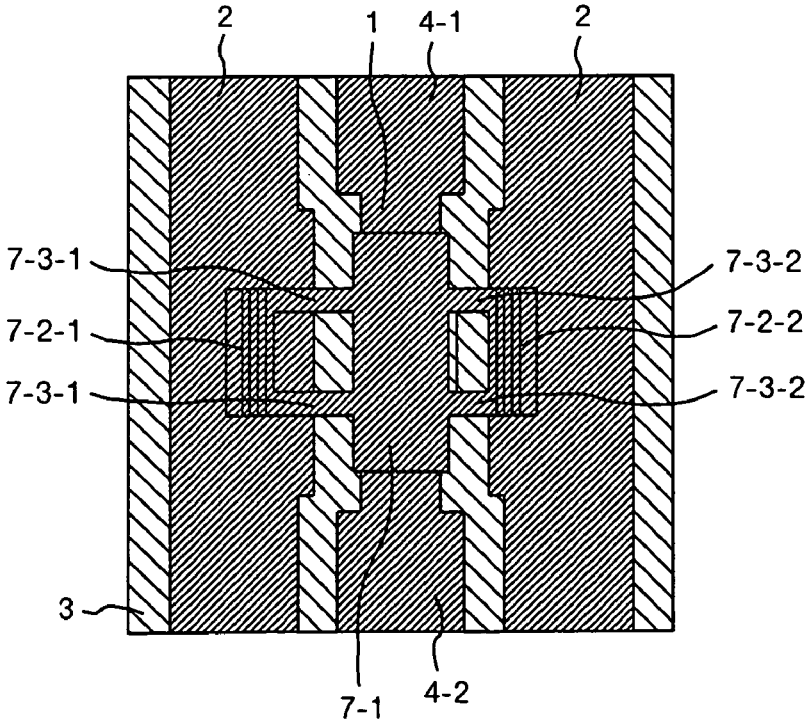
FIG. 8 is a top view explaining the third embodiment of the present invention.
Figure 9:
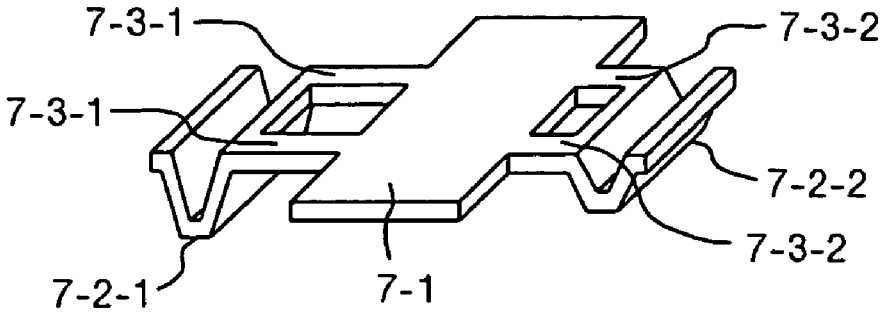
FIG. 9 is a perspective view explaining the structure of the membrane in the third embodiment of the present invention.

FIG. 7, FIG. 8, and FIG. 9 illustrate the third embodiment of the present invention. Unlike the second embodiment, the first spring 7-3-1 and the second spring 7-3-2 both function as flexible springs. The effect of the present invention is irrelevant to the type of spring, and flexible springs bring the same effect. When the spring constant of the first spring must be especially reduced to an small value, a torsional spring which can be reduced in size and force is preferably used. This can reduce the size and cost of the MEMS switch.

Figure 10:
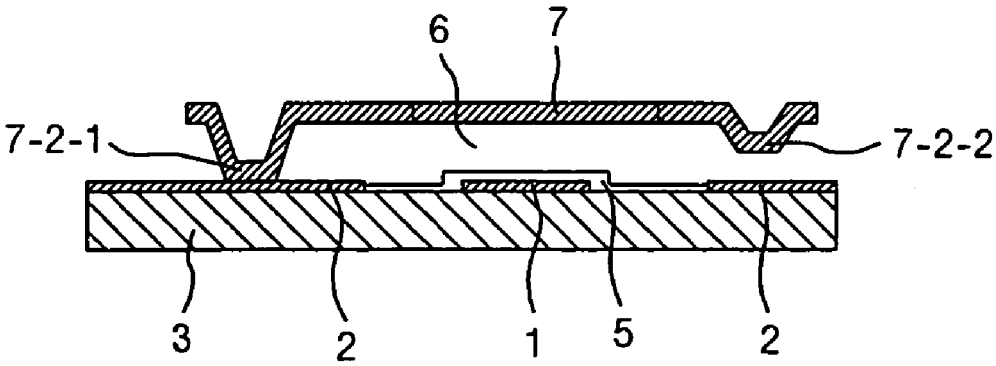
FIG. 10 is a cross-sectional view explaining a fourth embodiment of the present invention.
Figure 11:
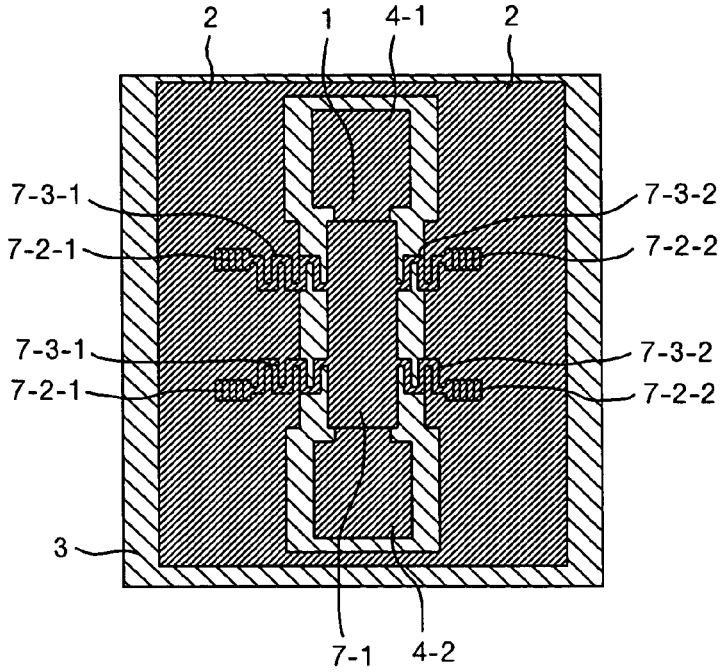
FIG. 11 is a top view explaining the fourth embodiment of the present invention.

FIG. 10 and FIG. 11 illustrate the fourth embodiment of the present invention. This embodiment is an improvement to the third embodiment, and uses meandering structure (zigzag structure) for springs. Use of the meandering structure enables reduction in size and spring constant. The spring constants can be made equal to the values in the first and second embodiments by designing and prototyping, and the same effect as in the first and second embodiments is obtained.

Figure 12:
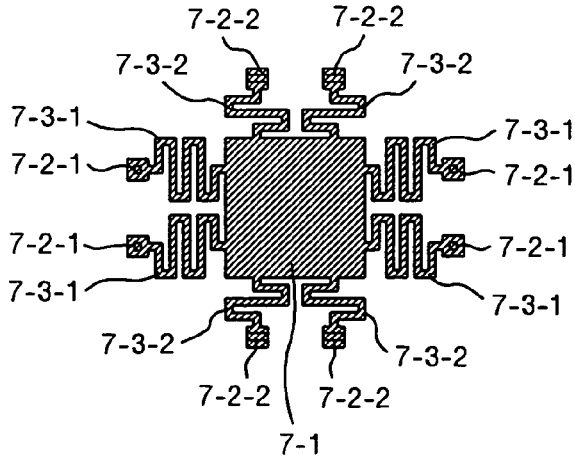
FIG. 12 is a top view explaining the structure of the membrane in a fifth embodiment of the present invention.

FIG. 12 illustrates the fifth embodiment of the present invention. This embodiment is the same as the fourth embodiment in that the meandering structure is used for springs. However, the former is different from the latter in the following: the first spring 7-3-1 is provided on two sides opposed to each other, and the second spring 7-3-2 is provided on the other two sides. Use of the meandering structure enables reduction in size and spring constant. Further, provision of the springs on the two sides, respectively, allows the upper electrodes 7-1 to be kept in parallel with the substrate and operated with stability.

Figure 13:
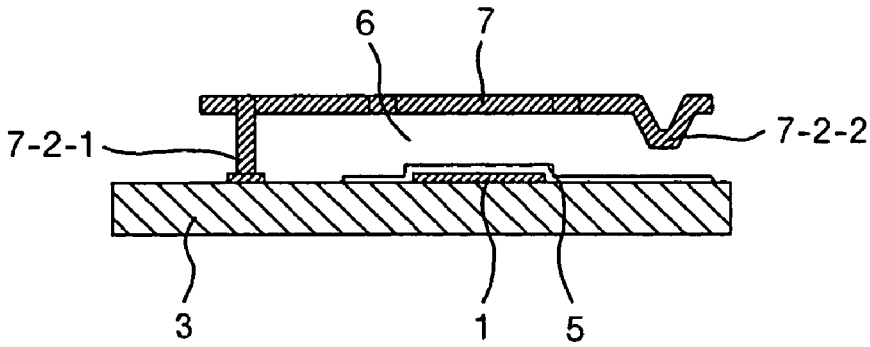
FIG. 13 is a cross-sectional view explaining a sixth embodiment of the present invention.
Figure 14:
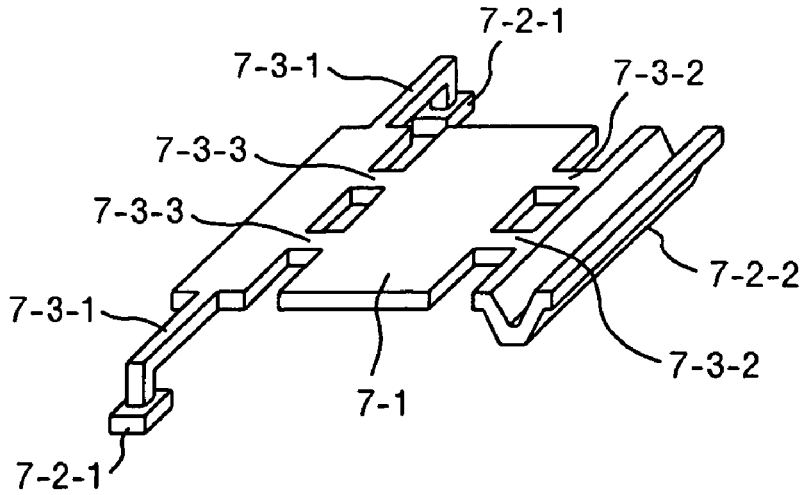
FIG. 14 is a perspective view explaining the structure of the membrane in the sixth embodiment of the present invention.

FIG. 13 and FIG. 14 illustrate the sixth embodiment of the present invention. This embodiment is of such a structure that a third spring 7-3-3 is provided between the first spring 7-3-1 and the upper electrode 7-1 in the above-mentioned second embodiment. The spring constant of the third spring 7-3-3 is set to a value higher than that of the first spring 7-3-1 and lower than that of the second spring 7-3-2. Provision of the third spring 7-3-3 brings the effect of preventing the first spring 7-3-1 as a torsional spring from being bent in on state.

Figure 15:
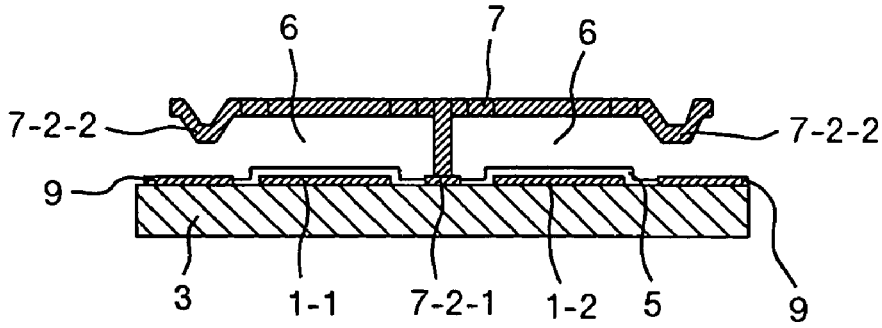
FIG. 15 is a cross-sectional view explaining a seventh embodiment of the present invention.
Figure 16:
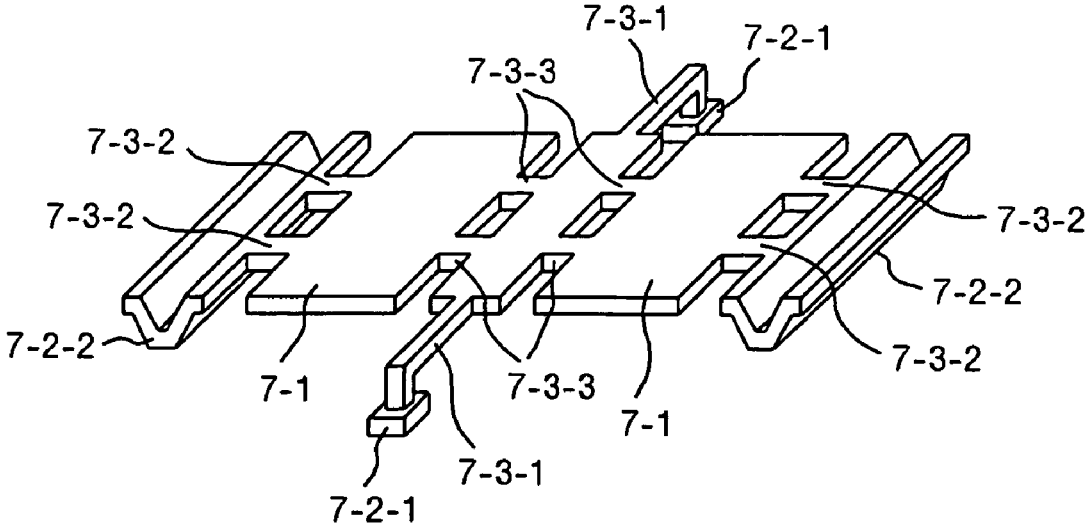
FIG. 16 is a perspective view explaining the structure of the membrane in the seventh embodiment of the present invention.

FIG. 15 and FIG. 16 illustrate the seventh embodiment wherein the present invention is applied to push-pull structure. This embodiment is of such a structure that the upper electrode 7-1 in the sixth embodiment is provided on the left and right of the first spring 7-3-1. Provision of the third spring 7-3-3 brings the effect of preventing the first spring 7-3-1 as a torsional spring from being bent in on state. Therefore, the opposite side is lifted up high, and this brings the effect of remarkably enhancing the off characteristics. Because of the presence of the second anchor 7-2-2, the upper electrode lifted up high can be restored with small Coulomb force. As a result, switching operation can be performed at still further lower voltage.

Figure 17:
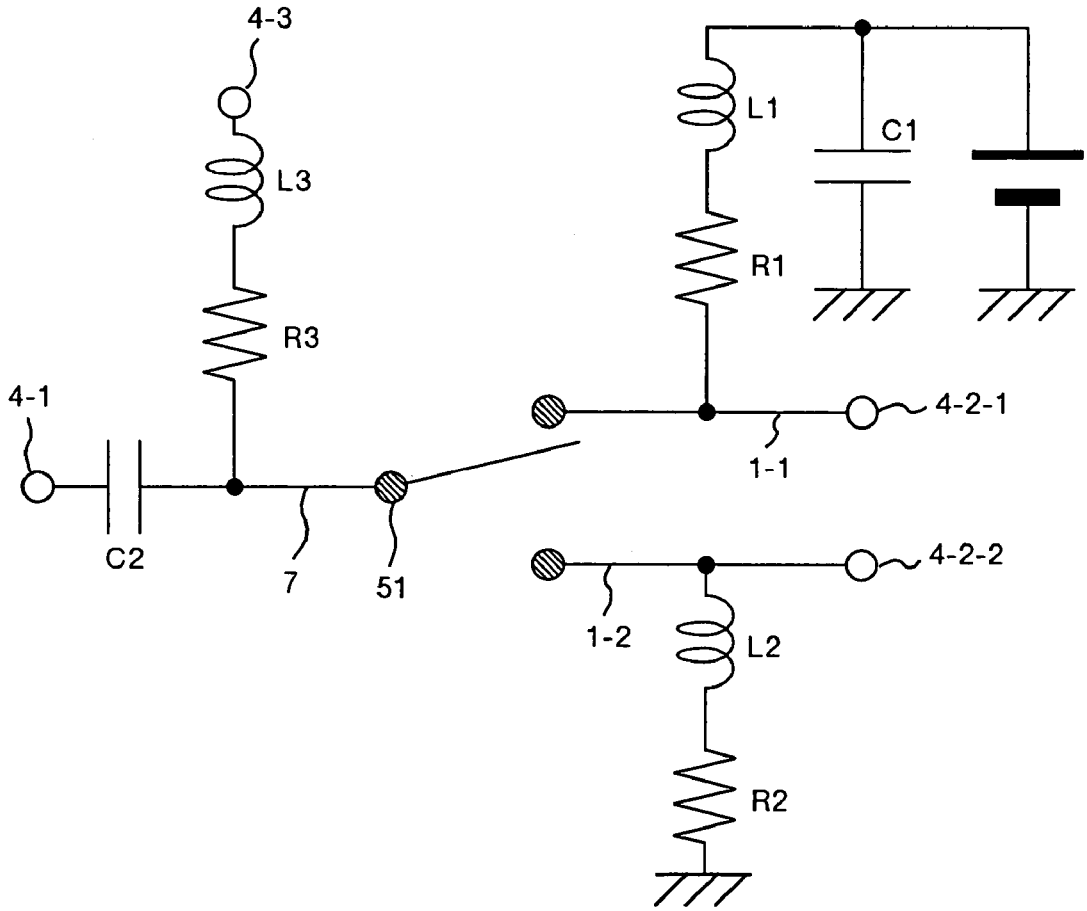
FIG. 17 is an equivalent circuit diagram explaining the seventh embodiment of the present invention and its control circuit.

FIG. 17 is an equivalent circuit diagram of an RF switch which uses the seventh embodiment as a one-input two-output switch 51 and its control circuit. In this embodiment, the membrane 7 is not connected to the ground but is connected to an input terminal 4-1. Further, an island-like metallic body 9 not connected to the ground is formed over the substrate 3 under the anchor 7-2-2. Then, either of the following operations is performed: the upper electrode 7-1 of the membrane 7 is connected to the left signal line 1-1 in high frequency and connects to its output terminal 4-2-1; and the upper electrode 7-1 is connected to the right signal line 1-2 in high frequency and connects to its output terminal 4-2-2.

More specific description will be given. The output port 4-2-1 is connected to 3V in DC through a resistor R1 and an inductance L1 which interrupt RF signals. The output port 4-2-2 is connected to the ground in DC through a resistor R2 and an inductance L2 which interrupt RF signals. A capacitor C1 is used to connect the terminal of 3V DC to the ground in high frequency. The membrane 7 is not connected in DC by a capacitor C2, and control voltage is applied to a control terminal 4-3 through a resistor R3 and an inductance L3 which interrupt RF signals. For this reason, when voltage of 3V is applied to the control terminal 4-3, the input terminal 4-1 is connected to the output terminal 4-2-2 in high frequency. When voltage of 0V is applied to the control terminal 4-3, the input terminal 4-1 is connected to the output port 4-2-1. The seventh embodiment is excellent in isolation in off state, and thus a one-input two-output switch of low loss can be implemented with one push-pull switch.

Figure 18:
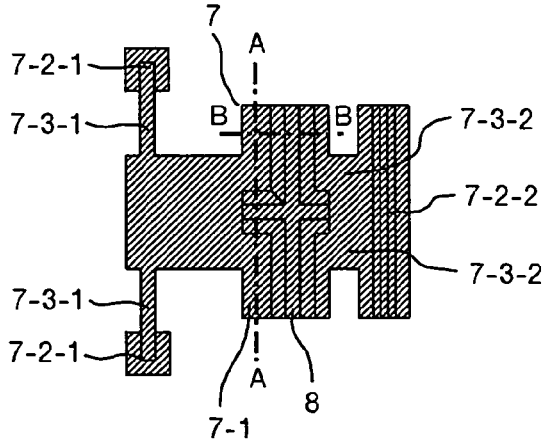
FIG. 18 is a plan view explaining the structure of the membrane in an eighth embodiment of the present invention.
Figure 19:
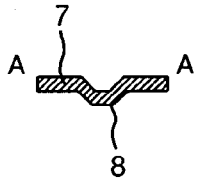
FIG. 19 is a cross-sectional view taken substantially along the line A-A of FIG. 18.
Figure 20:
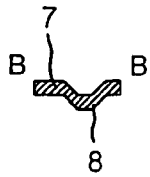
FIG. 20 is a cross-sectional view taken substantially along the line B-B of FIG. 18.

FIG. 18, FIG. 19, and FIG. 20 illustrate the eighth embodiment of the present invention. In this embodiment, dips (recesses) 8 are provided in the upper electrode 7-1 in the above-mentioned second embodiment. Two dips 8 whose depth is greater than the thickness of the membrane are formed in the linear directions in places on the membrane 7 where a warp is undesired. Presence of the dips 8 increases the stiffness of the parts with the dips against warp. Even when external force is exerted, therefore, the membrane 7 is less prone to warp in the directions of the straight lines of the dips 8. Since the dips 8 are crosswise formed in the upper electrode 7-1, a warp can be suppressed in the upper electrode 7-1. Further, a dip may be also provided in the first spring 7-3-1. In this case, bending of the first spring 7-3-1 can be suppressed by the dip.

To implement the first to eighth embodiments mentioned above, the gap distance between the upper electrode 7-1 and the signal line 1 and the gap distance between the second anchor 7-2-2 and the ground 2 must be controlled with accuracy. In these embodiments of the present invention, the membrane 7 including the upper electrode 7-1 and the second anchor 7-2-2 is formed in integral structure. Therefore, the gap distances can be controlled with accuracy.

However, when a conventional fabrication method is used to fabricate the membrane 7, the gap distance between the second anchor 7-2-2 and the ground 2 cannot be controlled with accuracy. Here, this problem will be described below.

Figure 21:
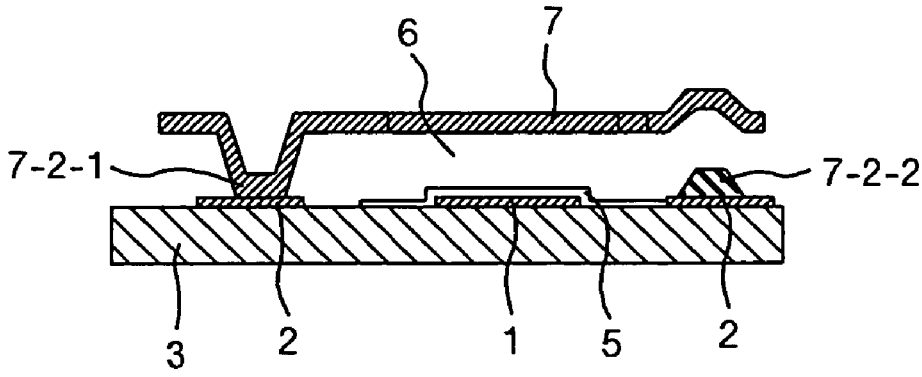
FIG. 21 is a cross-sectional view explaining a MEMS switch fabricated by a conventional fabrication method.

As an example, a cross-sectional view of a switch fabricated by a conventional fabrication method is presented as FIG. 21. In this example, the second anchor 7-2-2 in the second embodiment of the present invention is provided on the substrate 3 side. After the second anchor 7-2-2 is formed, a sacrificial layer is applied to form a membrane 7. Therefore, the gap distance between the second anchor 7-2-2 and the membrane 7 is substantially equal to the gap distance between the upper electrode 7-1 and the signal line 1. Thus, the effect of the present invention is not produced.

The gap can be reduced to some degree by selecting an appropriate material for the sacrificial layer and narrowing the second anchor 7-2-2. However, this method is inferior in controllability and significantly complicates the manufacturing process.

The effect similar to that of the present invention can be obtained by grinding and planarizing the surface of the sacrificial layer before the formation of the membrane 7. However, the thickness of the sacrificial layer cannot be controlled in the submicron range by grinding using abrasives and a turntable. Even when surface planarization equipment using ions and ion clusters is used, it is inferior in film thickness controllability and throughput, and expensive equipment is required. Therefore, a low-cost switch cannot be provided.

Figure 22:
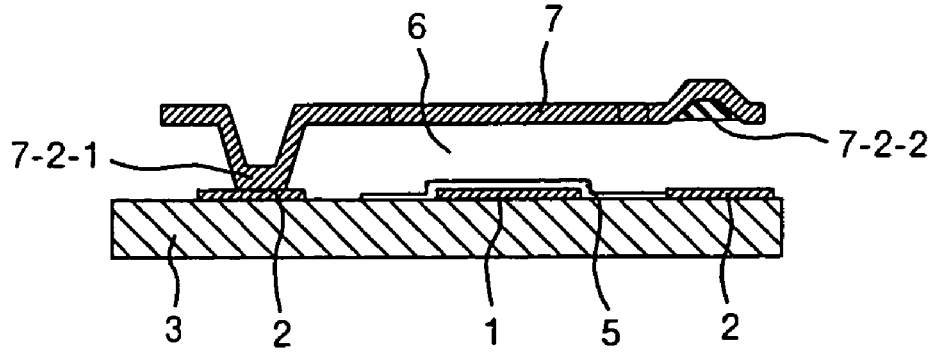
FIG. 22 is a cross-sectional view explaining a MEMS switch fabricated by another conventional fabrication method.

FIG. 22 is a cross-sectional view of the switch fabricated by another conventional fabrication method. In this switch, the second anchor 7-2-2 in the second embodiment of the present invention is provided on the membrane 7 side. After a sacrificial layer is applied, the second anchor 7-2-2 and the membrane 7 are formed. Therefore, as in the case illustrated in FIG. 21, the gap distance between the second anchor 7-2-2 and the membrane 7 is substantially equal to the gap distance between the upper electrode 7-1 and the signal line 1. Thus, the effect of the present invention is not produced.

The effect similar to that of the present invention can be obtained by providing a dip in the surface of the sacrificial layer before the formation of the second anchor 7-2-2. However, the depth of the dip cannot be controlled in the submicron range. When a stopper layer is used, expensive equipment and complicated techniques are required, and thus a low-cost switch cannot be provided.

In the first place, in the conventional switch illustrated in FIG. 22, the integral structure of the membrane 7 gives way because the second anchor 7-2-2 is additionally provided. As a result, the following problem arises: when the membrane 7 is formed under conditions for suppressing warp in the portion of the membrane 7 connected with the second anchor 7-2-2, a warp occurs in other portions of the membrane. When the membrane 7 is formed under conditions for suppressing warp in other portions of the membrane, a warp occurs in the portion of the membrane 7 connected with the second anchor 7-2-2.

As mentioned above, the membrane 7 according to the present invention is of integral structure. Therefore, warp can be easily suppressed by optimizing the film formation process conditions.

Figure 23:
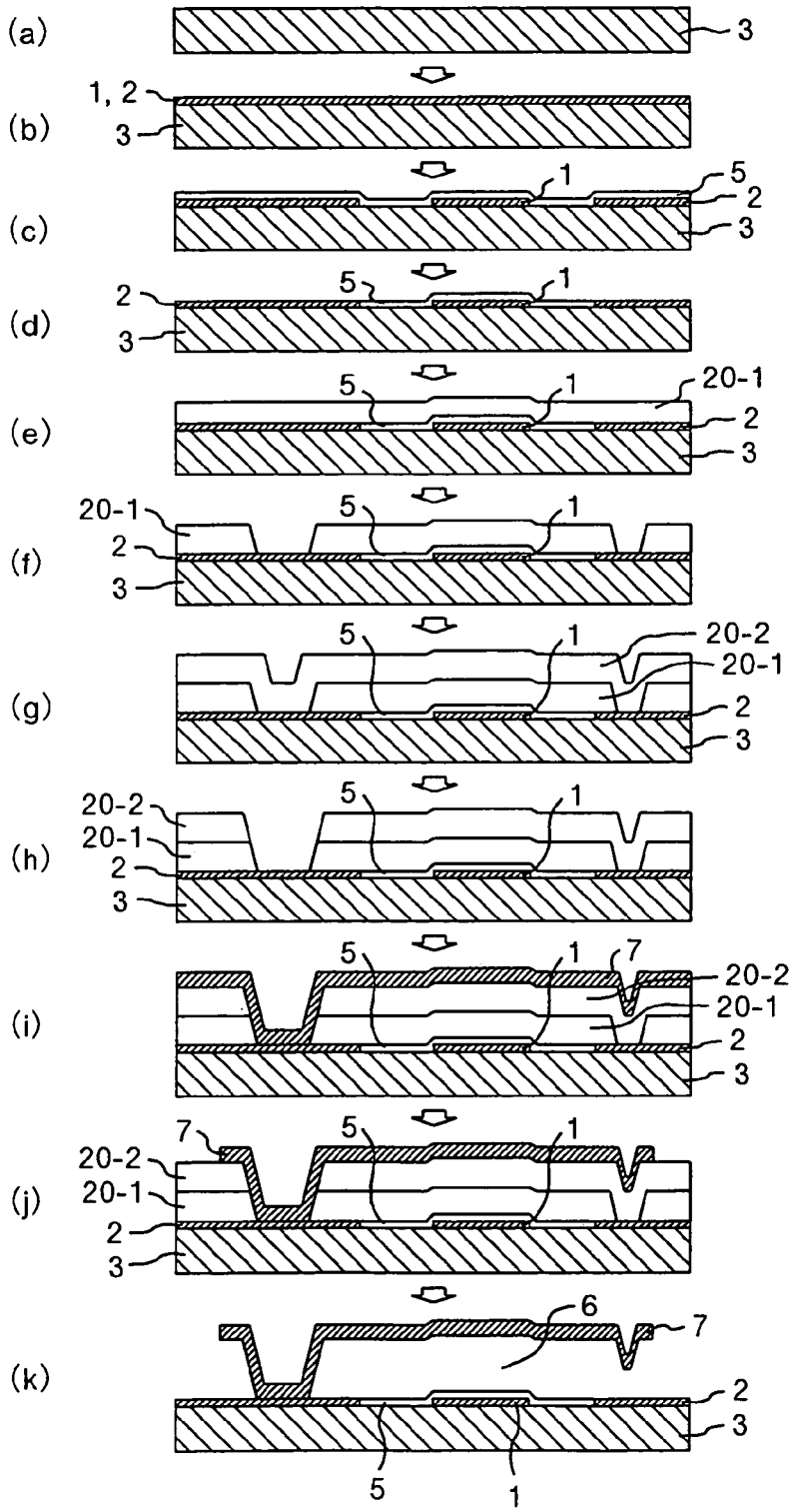
FIG. 23 is a process drawing explaining the fabrication method for the second embodiment of the present invention.

FIG. 23 illustrates the fabrication method for the second embodiment of the present invention. Over a substrate 3 (a in FIG. 23), a metallic film 1, 2 is formed (b in FIG. 23) and patterned (c in FIG. 23), and an insulating film 5 is formed (c in FIG. 23) and patterned (d in FIG. 23). Thus, a signal line 1, ground 2, and dielectric film 5 are formed (d in FIG. 23).

An aluminum film, 200 nm in thickness, is formed as the metallic film 1, 2 by resistor heating evaporation. When a sputtering process is used for the film formation, the surface flatness of the aluminum is enhanced, and the electrical characteristics in on state is further enhanced. When a gold film is formed in place of the aluminum film by electron beam evaporation, the resistance value can be reduced. When another gold film is further formed on the above gold film by plating, the resistance value can be further reduced. In case a gold film is formed by evaporation, titanium, chromium, molybdenum, or the like, 50 nm or so in thickness, can be provided as an adhesive layer for adjacent layers. Thus, the adhesion is enhanced.

As the dielectric film 5, a silicon dioxide film, 100 nm in thickness, is formed by a sputtering process. Aluminum oxide, silicon nitride, or aluminum nitride may be used in place of silicon dioxide. In this case, their dielectric constant is high, and the electrical characteristics in on state can be improved.

Next, a polyimide film is formed over the dielectric film 5 (e in FIG. 23) and patterned (f in FIG. 23) twice (g and h in FIG. 23) to form sacrificial films (20-1, 20-2). The sacrificial films (20-1, 20-2) are respectively formed by applying a polyimide film, 1100 nm in thickness, by rotation painting. When photosensitive polyimide is used, the sacrificial films can be formed by carrying out application, exposure, and etching twice. Therefore, the process can be simplified, and an inexpensive switch can be provided.

Next, a metallic film 7 is formed over the sacrificial layer (20-2) (i in FIG. 23) and patterned (j in FIG. 23) to form a membrane 7. The metallic film 7 is formed by forming an aluminum film, 2000 nm in thickness, by electron beam evaporation. Thus, the membrane 7 of integral structure is formed by one time of formation and patterning of a metallic film.

If a sputtering process is used for film formation, the surface flatness of aluminum is enhanced, and the deviation in devices within a wafer can be reduced. Further, when a gold film is formed in place of the aluminum film by electron beam evaporation, the resistance value can be reduced. When another gold film is further formed by plating, the resistance value can be further reduced. In case a gold film is formed by evaporation, titanium, chromium, molybdenum, or the like, 50 nm or so in thickness, can be provided as an adhesive layer for adjacent layers. Thus, the adhesion is enhanced.

Last, the polyimide is removed by chemical dry etching (k in FIG. 23). As the result of the removal of polyimide, a gap 6 is formed.

If the above fabrication method is used, the membrane 7 can be shaped as follows: the shape of the membrane 7 in the direction of the depth is obtained by patterning of polyimide, and the shape of the membrane 7 in the direction of the plane is obtained by patterning of the latter metallic film. Thus, the membrane 7 can be easily and accurately fabricated with a smaller number of fabrication steps. The fabrication method according to the present invention does not require a method using abrasives and a turntable or surface planarization equipment using ions or ion clusters. Therefore, the fabrication method according to the present invention is excellent in film thickness controllability and throughput. Further, the present invention allows the switch to be fabricated by inexpensive equipment, and thus allows a low-cost switch to be provided.

According to the present invention, a membrane is provided with a second anchor floating in midair, and thus sticking phenomena can be prevented. As a result, the switching voltage of a MEMS switch can be lowered.

Further, according to the present invention, the springs, anchors, and upper electrode of a membrane are constituted in integral structure. Therefore, a MEMS switch which operates at low voltage can be inexpensively provided. In addition, since unwanted warp in the membrane can be suppressed, the following effects are produced: designing is facilitated; deviation in manufacturing process is suppressed; and a more inexpensive MEMS switch is provided.

It is further understood by those skilled in the art that the foregoing description is a preferred embodiment of the disclosed device and that various changes and modifications may be made in the invention without departing from the spirit and scope thereof.

What is claimed is:

1. A MEMS switch comprising:

a base portion including a substrate;

a first anchor formed over said substrate;

a first spring connected to said first anchor;

an upper electrode member connected to said first spring, wherein said upper electrode member makes a motion above said substrate by elastically deforming said first spring;

a lower electrode member formed over said substrate and positioned under said upper electrode member;

a second spring connected to said upper electrode member; and a movable second anchor connected to said second spring, wherein said MEMS switch is switched on or off by switching contacting state between said upper electrode member and said lower electrode member, wherein said movable second anchor is brought into contact with said base portion before said MEMS switch turns on, wherein said second spring applies upward force to said upper electrode member when said MEMS switch is on; and wherein said lower electrode member includes an insulator film formed over a lower electrode, and when said upper electrode member is brought into contact with said lower electrode member, electrical capacitance is produced between said upper electrode member and said lower electrode member.

2. The MEMS switch according to claim 1, wherein said first spring, said first anchor, said second spring, said movable second anchor, and said upper electrode member are constituted in an integral structure and are formed of a continuous metallic body.

3. The MEMS switch according to claim 2, wherein said metal is a metal predominantly comprised of aluminum.

4. The MEMS switch according to claim 1, wherein a restoring force of said first spring is an elastic force of a solid against torsion, and a restoring force of said second spring is an elastic force of a solid against flexure.

5. The MEMS switch according to claim 1, wherein a metallic body is formed over said substrate under said second anchor.

6. The MEMS switch according to claim 1, wherein said upper electrode member has dips greater than a thickness of the upper electrode member.

7. The MEMS switch according to claim 1, wherein a respective said upper electrode, a respective said second spring, and a respective said movable second anchor are attached in that order at each of two sides of said first spring to form a push-pull structure.

8. A MEMS switch comprising:

a base portion including a substrate;

a first anchor formed over said substrate;

a first spring connected to said first anchor;

an upper electrode member connected to said first spring, wherein said upper electrode member makes a motion above said substrate by elastically deforming said first spring;

a lower electrode member formed over said substrate and positioned under said upper electrode member;

a second spring connected to said upper electrode member; and a movable second anchor connected to said second spring, wherein said MEMS switch is switched on or off by switching a contacting state between said upper electrode member and said lower electrode member, wherein said movable second anchor is brought into contact with said base portion before said MEMS switch turns on, wherein said second spring applies upward force to said upper electrode member when said MEMS switch is on, and wherein a respective said upper electrode, a respective said second spring, and a respective said movable second anchor are attached in that order at each of two sides of said first spring to form a push-pull structure.

* * * * *